US006281769B1

(12) United States Patent
Fiedziuszko

(10) Patent No.: US 6,281,769 B1
(45) Date of Patent: Aug. 28, 2001

(54) ELECTROMAGNETIC TRANSMISSION LINE ELEMENTS HAVING A BOUNDARY BETWEEN MATERIALS OF HIGH AND LOW DIELECTRIC CONSTANTS

(75) Inventor: Slawomir J. Fiedziuszko, Palo Alto, CA (US)

(73) Assignee: Space Systems/Loral Inc., Palo Alto, CA (US)

( * ) Notice: Subject to any disclaimer, the term of this patent is extended or adjusted under 35 U.S.C. 154(b) by 0 days.

(21) Appl. No.: 09/207,877

(22) Filed: Dec. 8, 1998

Related U.S. Application Data

(62) Division of application No. 08/568,673, filed on Dec. 7, 1995, now Pat. No. 5,889,449.

(51) Int. Cl.[7] ..... H01P 3/16
(52) U.S. Cl. ..... 333/239; 333/248
(58) Field of Search ..... 333/239, 248, 333/238

(56) References Cited

U.S. PATENT DOCUMENTS 2,829,351 * 4/1958 Fox ..... 333/239
4,463,330 * 7/1984 Yoneyoma ..... 333/239
4,707,671 * 11/1987 Suzuki et al. ..... 333/1
4,800,350 * 1/1989 Bridges et al. ..... 333/239

FOREIGN PATENT DOCUMENTS

2217114 * 10/1989 (GB) ..... 333/239

* cited by examiner

*Primary Examiner*—Benny Lee
(74) *Attorney, Agent, or Firm*—Perman & Green, LLP

(57) ABSTRACT

An electromagnetic wave propagation structure, suitable for the transmission of an electromagnetic wave and the formation of resonators within filters, is constructed of both high and low dielectric-constant materials wherein the high dielectric-constant is in excess of approximately 80 and the low dielectric-constant is less than approximately 2. A boundary between the high and the low dielectric-constant materials serves as an electric wall to waves propagating in the low dielectric-constant material and as a magnetic wall to waves propagating in the high dielectric-constant material. This permits substitution of the high dielectric-constant material for metal elements, such as resonators and feed structures in filters. Furthermore, the use of a cladding of dielectric material of one of the foregoing dielectric ranges about a core of material of the other of the foregoing dielectric ranges enables construction of waveguides having rectangular and circular cross-sections. Microstrip and stripline structures with substitution of the high dielectric-constant material for the harmonic elements may also be constructed.

2 Claims, 5 Drawing Sheets

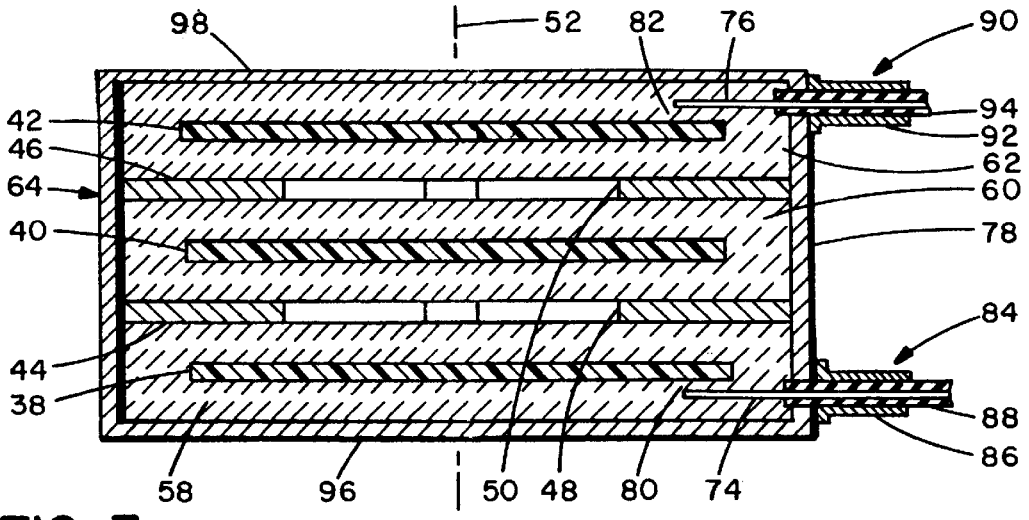
FIG. 3
FIG. 4
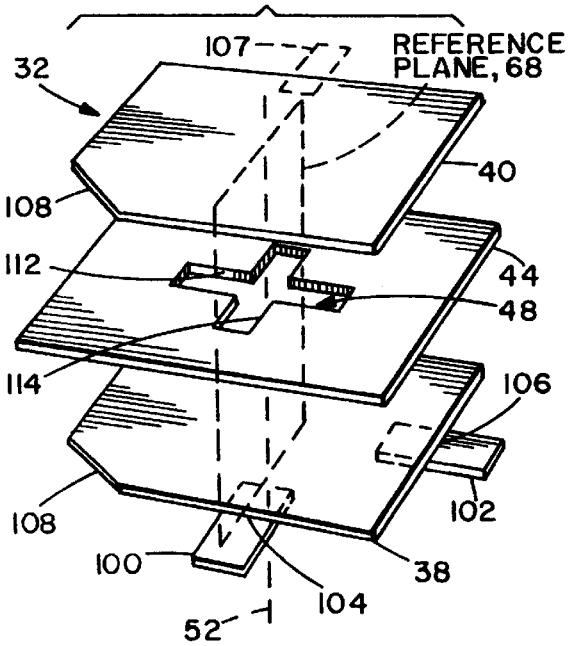
FIG. 5
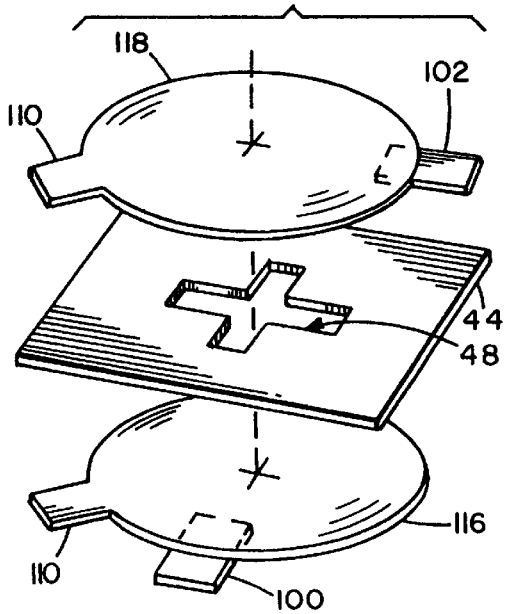
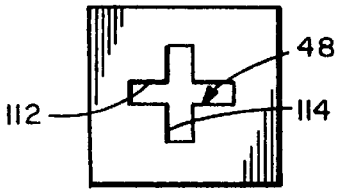
FIG. 6
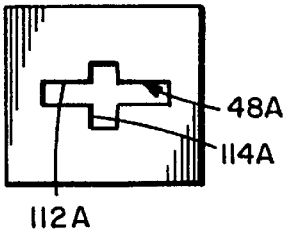
FIG. 7
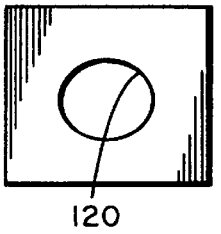
FIG. 8

FIG. 9
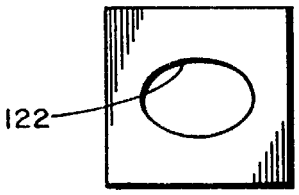
FIG. 10
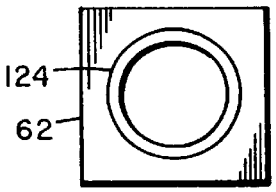
FIG. 11
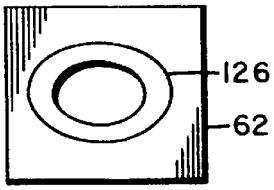
FIG. 12
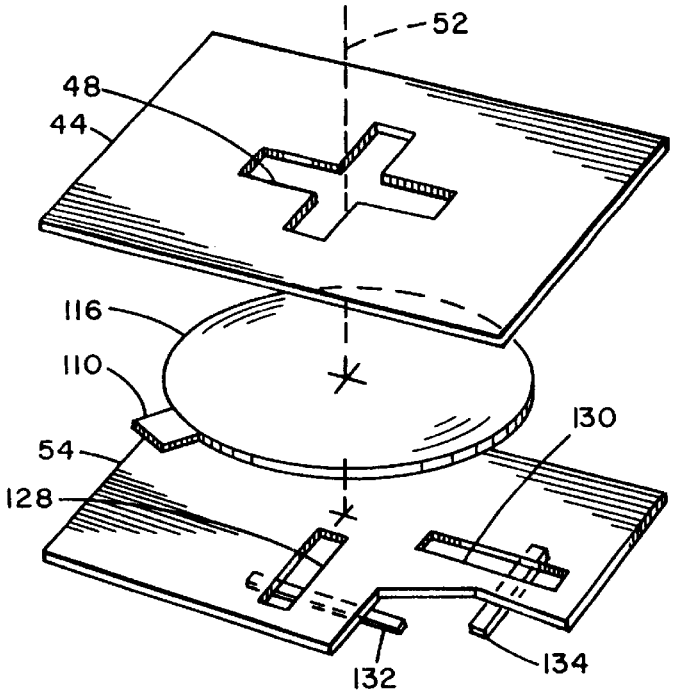
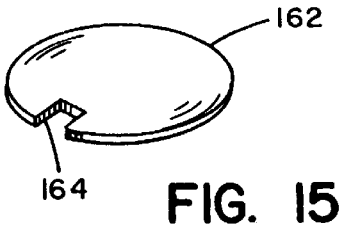
FIG. 15
FIG. 14
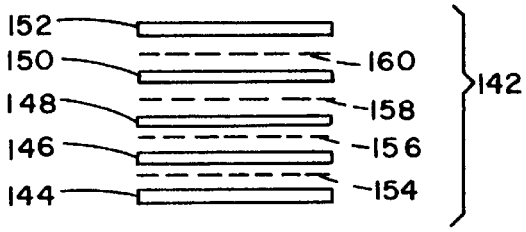
FIG. 13
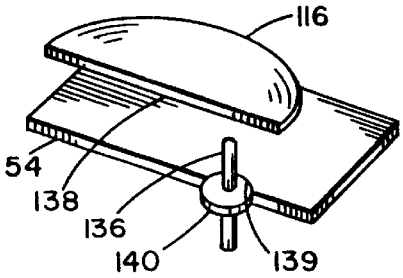

ELECTROMAGNETIC TRANSMISSION LINE ELEMENTS HAVING A BOUNDARY BETWEEN MATERIALS OF HIGH AND LOW DIELECTRIC CONSTANTS

RELATED APPLICATION

This application is a division of application Ser. No. 08/568,673 filed Dec. 7, 1995, now U.S. Pat. No. 5,889,449.

BACKGROUND OF THE INVENTION

This invention relates to the construction of electromagnetic transmission line elements including resonating, coupling and wave-guiding elements, and more particularly, to the construction of such elements by use of a boundary between two dielectric materials of high and low dielectric constants, the low dielectric constant being in the range of approximately 1–2 and the high dielectric constant being in the range of 80–100 or higher.

One well known form of transmission line structure employs a region of metallic material separated from a second region of metallic material by a region of electrically insulating material. Such a transmission line structure includes microstrip wherein an electrically conductive strip is separated from a parallel conducting plate by a layer of insulating material. As a further example of transmission line, a coplanar waveguide comprises a pair of parallel conductive strips spaced apart by an insulator. The latter structure, in combination with an insulated back metallic plate or ground plane as in stripline or microstrip, can also serve as a coupler of microwave signals between two microstrip circuits, upon a reduction in the spacing between the conductive strips. In similar fashion, two or more electrically insulated conductive strips, patches or resonators may be disposed in a coplanar array spaced apart from a ground plane to serve as a filter, or may be stacked, one above the other and insulated from each other to form a filter. In the latter configuration of stacked resonators, it is the practice to enclose, at least partially, each of the resonators in a metallic cavity type of structure with provision for electromagnetic coupling between the resonators.

In each of the foregoing structures, the physical size of the structure, for provision of a desired electromagnetic characteristic, is determined by the electromagnetic wavelength in air, vacuum, or dielectric environment in which the metallic elements are situate. However, there are situations such as in communication via satellite, wherein it is desirable to reduce the physical size and weight of the microwave components and the circuitry composed of such components. Microwave components of unduly large size and weight create a packaging problem for satellite borne electronic equipment.

The foregoing problem may be demonstrated by the following example concerning microwave filters. Filters of electromagnetic signals, such as microwave signals, typically provide a bandpass function characterized by a multiple-pole transmission band. A typical construction employs a plurality of metallic resonators of planar form which are stacked one above the other to provide for plural modes of electromagnetic vibration within a single filter. The resonators are spaced apart and supported by dielectric, electrically-insulating material. Metallic plates with irises may be disposed between the resonators for coupling electromagnetic power among the resonators. In the case of cavity-resonator filters, each cavity is physically large, particularly at lower frequencies, the physical size militating against the use of the cavity filters. Thus, in situations wherein there is limited space available for electronic circuits, such as in satellites which serve as part of a communication system, there is a need to reduce the size of filters, as well as to decrease the weight of filters employed in the signal processing circuitry.

The filters are employed in numerous circuits for signal processing, communication, and other functions. Of particular interest herein are circuits, such as those which may be constructed on a printed circuit board, and are operable at microwave frequencies, such as frequencies in the gigahertz region. Such signals may be processed by transistors and other solid state devices, and may employ analog filters in the form of a series of cavity resonators, or resonators configured in microstrip form. By way of example, to provide a band-pass filter having an elliptic function or a Chebyshev response, and wherein a mathematical representation of the response is characterized by numerous poles, the filter has many sections. Each section has a single resonator, in the microstrip form of circuit, for each pole which is to be produced in the filter transfer function.

In order to reduce the physical size of such a filter, the filter may be constructed of a series of dielectric resonators enclosed within metallic cavities, as is disclosed in Fiedziuszko, U.S. Pat. No. 4,489,293, this patent describing the construction and tuning of a multiple, dielectric-loaded, cavity filter. Such a dielectric resonator filter is employed in situations requiring reduced physical size and weight of the filter, as is desirable in a satellite communication system wherein such a filter is to be carried on board the satellite as a part of microwave circuitry. The reduction in size of such a filter arises because the wavelength of an electromagnetic signal within a dielectric resonator is substantially smaller than the wavelength of the same electromagnetic signal in vacuum or in air. Coupling of electromagnetic power between contiguous cavities may be accomplished by means of slotted irises or other electromagnetic coupling structures.

The foregoing attempts to reduce the size of microwave components, such as the foregoing filters, by use of dielectric materials have been successful to a limited extent, the limitation devolving from the fact that, in the case of the foregoing filters, the inner space of a cavity is filled partially with air and partially with the dielectric resonator. Furthermore, as noted above for satellite communications, it is important also to reduce the weight of the microwave components, and such weight reduction is limited in the foregoing construction of filter due to the fact that the cavity walls and iris plates are constructed of metal rather than than a lighter material. Thus, there is a need to treat further the foregoing problem of excess size and weight.

SUMMARY OF THE INVENTION

The aforementioned problem is overcome and other advantages are provided by the construction of transmission line elements including resonating, coupling, and wave-guiding elements by means of dielectric material, wherein a first region of the dielectric material has a low dielectric constant in the range of typically 1–2 and a second region of the dielectric material has a high dielectric constant in the range of at least 80–100. The first and the second regions are contiguous to each other at a boundary, and both of the regions are capable of supporting propagation of electromagnetic waves wherein the waves reflect from the boundary.

Upon expressing the waves in each of the regions mathematically, and upon solving the wave equations to fit the boundary conditions, it is observed that a plane electromagnetic wave propagating in the first region (low dielectric constant) reflects from the boundary in essentially the same manner as a wave reflecting from a metal electrically conducting wall, or "electric wall". Furthermore, a plane electromagnetic wave propagating in the second region (high dielectric constant) reflects from the boundary in essentially the same manner as a wave reflecting from a "magnetic wall". In the case of reflection of the wave from the electric wall, the normal component of the magnetic field and the tangential component of the electric field of the electromagnetic wave vanish; therefore this boundary condition is equivalent at high frequencies to a metal wall. In the case of reflection of the wave from the magnetic wall, the tangential component of the magnetic field and the normal component of the electric field of the electromagnetic wave vanish; therefore, this boundary condition is equivalent at low frequency to an open circuit condition.

The principles of the invention are carried out best in the situation wherein the ratio of the high dielectric constant to the low dielectric constant is equal to or greater than approximately 40. This ratio is in conformance with the foregoing exemplary ranges of dielectric constant of 1–2 for the low dielectric and of 80–100 for the high dielectric. If dielectric materials with dielectric constants greater than 100 are available, then it is advantageous to employ such higher dielectric-constant materials in the practice of the invention. It is noted also that, by way of example, it is possible to practice the invention with a smaller difference in the range of dielectric materials, for example, a low dielectric-constant of possibly 3 or 4, and a high dielectric-constant of possibly 70. However, with such a reduced ratio between the high and the low dielectric-constants, the foregoing boundary with its electromagnetic characteristic of electric walls and magnetic walls is less pronounced, and the operation of the invention is somewhat degraded as compared to the foregoing ranges of low dielectric-constant and high dielectric-constant.

In the foregoing situation wherein there is an adequate ratio of high dielectric-constant to low dielectric-constant, there is substantially total reflection of a wave at the boundary, except for an evanescent field beyond the boundary. Due to the substantially total reflection, a microwave structure comprising a region of the low dielectric-constant material enclosed by an encircling wall-like region of the high dielectric-constant material functions, with respect to an electromagnetic wave within the low dielectric-constant material, as a microwave cavity. Introduction of a disk of the high dielectric-constant material within the cavity is equivalent to the emplacement of a resonator within the cavity. Thus, one can construct a multiple cavity microwave filter totally from the dielectric material by substitution of the foregoing high dielectric-constant material as replacement for the metal parts of the typical cavity filter. Such metal parts include the cavity wall, irises between cavity sections for the coupling of electromagnetic signals between cavities, a resonator within a cavity, and feed structures for inputting and for outputting the signals from the multiple cavity filter. The remaining air space is replaced with the low dielectric-constant material. By way of example in the construction of such a filter, the resonator may be constructed as a thin film of the high dielectric-constant material supported on a substrate of the low dielectric-constant material.

In similar manner, other microwave structures can be fabricated by the substitution of the high dielectric-constant material for metal, and by replacing the remaining space with the low dielectric-constant material. In the case of a microstrip or stripline microwave structure, such as coplanar waveguide, the coplanar waveguide may be constructed by the deposition of two parallel spaced-apart strips of the high dielectric-constant material as thin films upon a substrate of the low dielectric-constant material. Upon a reduction in the spacing between the two strips in a portion of the coplanar waveguide, use may be made of the aforementioned evanescent field to create a microwave four-port hybrid coupler. In similar fashion, two or more electrically insulated conductive strips, patches, or resonators may be disposed in the form of a thin film of the high dielectric-constant material on a substrate of the low dielectric-constant material, and arranged in a coplanar array spaced apart from a ground plane to serve as a filter, or may be stacked, one above the other and insulated from each other to form a filter. Furthermore, the inverse structure of at least some of the foregoing microwave devices can be employed to advantage, wherein the location of the high dielectric-constant material is interchanged with the location of the low dielectric-constant material. This provides, by way of example, a waveguide analogous to an optical fiber and comprising a rod of the high dielectric-constant material surrounded by a sheath of the low dielectric-constant material for the conduction of a microwave signal.

An important advantage of the invention is that metallic losses present in the corresponding microwave structures of the prior art are absent in the microwave structures of the invention. The microwave structures of the invention have only dielectric and radiation losses for a realization of improved performance and lower loss over the microwave structures of the prior art. The advantages of the invention may be compared to the advantages of superconductive microwave components, except that the invention provides the additional benefit of avoiding the expensive and bulky cooling apparatus associated with superconducting components.

To demonstrate the principles of the invention, the foregoing structures will be described beginning, by way of example, with a plural-cavity filter having metallic resonators, followed by substitution of the high dielectric-constant material for the metal of the resonators as well as for metal part of other microwave structures.

BRIEF DESCRIPTION OF THE DRAWING

The aforementioned aspects and other features of the invention are explained in the following description, taken in connection with the accompanying drawing wherein:

FIG. 3 is a sectional view taken along a central plane of the filter of FIG. 1 in an alternative embodiment employing an arrangement of coupling elements which differs from the arrangement of FIG. 2;

FIG. 4 is a simplified exploded view of the filter of FIG. 1 in accordance with a further embodiment having yet another arrangement of coupling elements, and disclosing details in the construction of perturbations of resonators of the filter, the resonators having a substantially square, or slightly rectangular shape;

FIG. 5 is a further simplified exploded view of the filter of FIG. 1 wherein coupling elements are provided in accordance with yet a further arrangement, and wherein the resonator perturbations are constructed in accordance with a further embodiment, the resonators having a circular shape;

FIGS. 6, 7, 8 and 9 show different embodiments of a coupling iris employed in the filter;

FIGS. 10 and 11 show schematic views of resonators of the filter constructed in accordance with a further embodiments having an annular form, each of the resonators being shown disposed upon a layer of dielectric material wherein, in FIG. 10, the resonator has a circular annular shape and wherein, in FIG. 11, the resonator has an elliptical annular shape;

FIG. 12 discloses a simplified exploded view of the filter presenting coupling structure in the form of a pair of slots, and wherein the resonator may be slightly elliptical in shape;

FIG. 13 shows a fragmentary view of a further coupling structure for the filter wherein a probe is oriented perpendicularly to the plane of a resonator;

FIG. 14 is a schematic representation of a stack of five resonators, indicated in solid line, with a set of four electrically-conductive sheets, indicated as dashed lines, interposed between the resonators;

FIG. 15 shows diagrammatically an alternative configuration of the resonator of FIG. 12 wherein the perturbation is in the form of a notch;

Identically labeled elements appearing in different ones of the figures refer to the same element in the different figures but may not be referenced in the description for all figures.

DETAILED DESCRIPTION OF THE INVENTION

Figure 1:
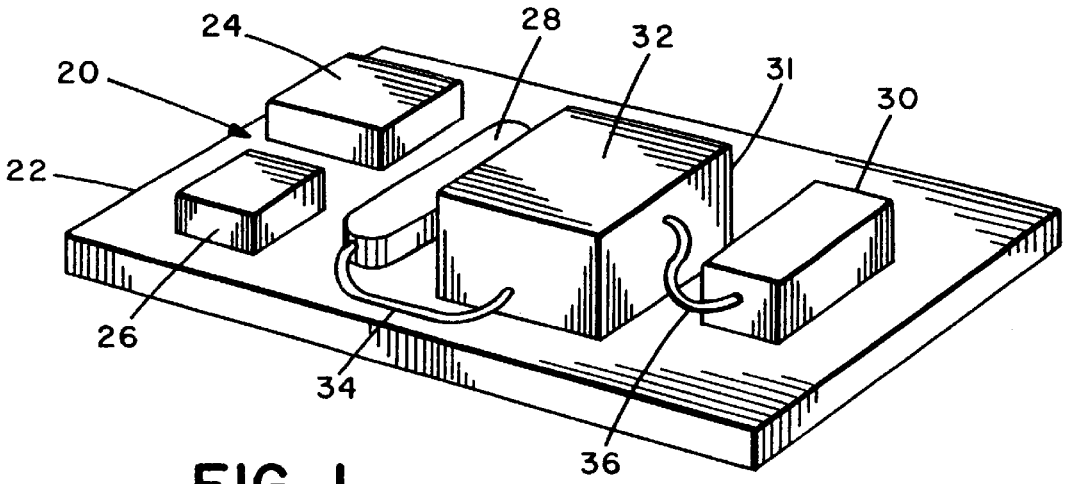
FIG. 1 is a stylized view of a circuit board including a circuit module, such as a filter, constructed in accordance with the invention.

FIG. 1 shows a circuit 20 constructed upon a circuit board 22 of insulating material and having components 24, 26, 28, and 30 mounted on the board 22 and interconnected via various conductors (not shown). By way of example, the components 24, 26, 28, and 30 may include an amplifier, a modulator, as well as converters between analog and digital signals. Also included in the circuit 20 is a circuit module 31 constructed in accordance with the invention. By way of example, the circuit module 31 may be a filter 32. The filter 32 is connected by coaxial cables 34 and 36, respectively, to the circuit components 28 and 30.

Figure 2:
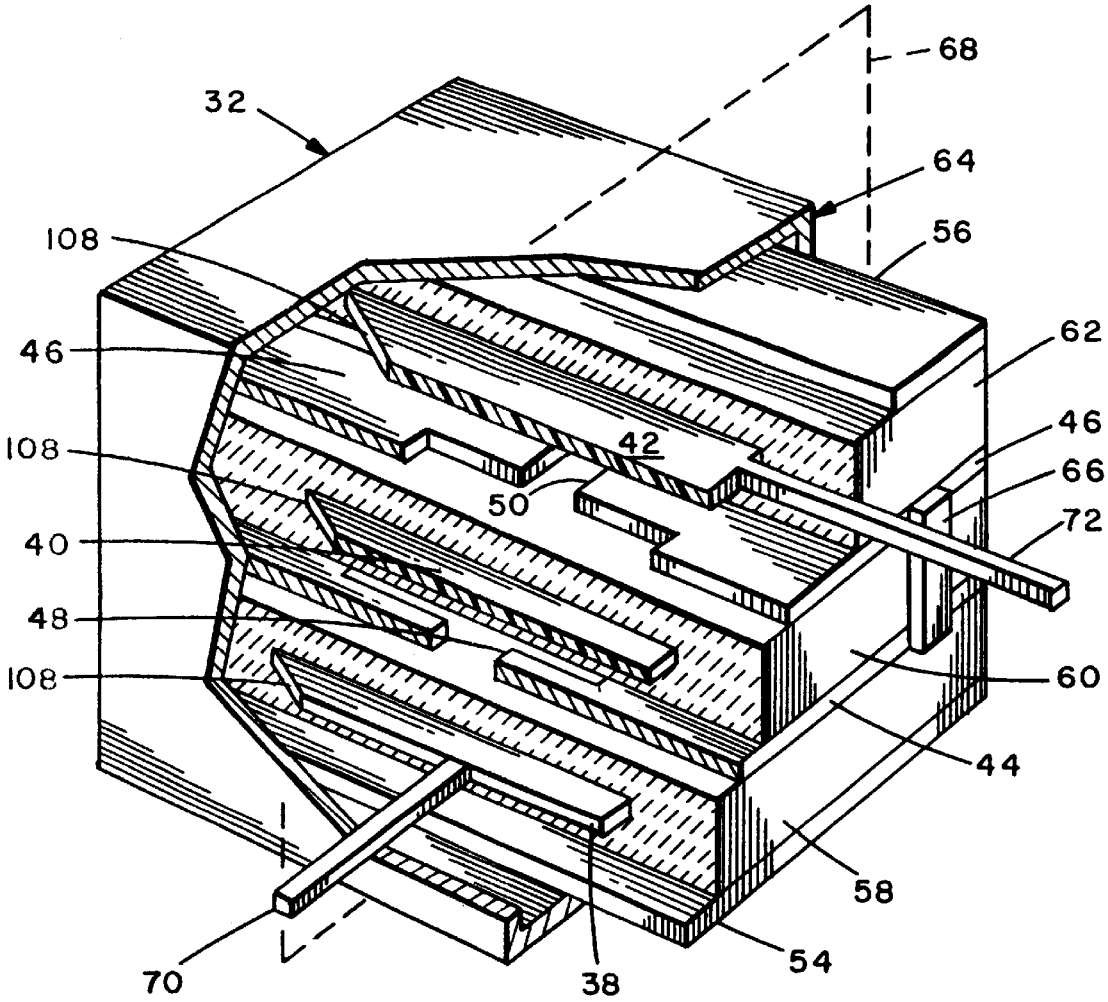
FIG. 2 is an isometric view of the filter of the circuit module of FIG. 1, portions of the filter being cut away to show details of construction.

In accordance with a first embodiment of the invention, and as shown in FIG. 2, the filter 32 comprises a set of resonators 38, 40 and 42 with electrically conductive sheets 44 and 46 respectively disposed between the resonators 38, 40, and 42. The sheet 44 is provided with an iris 48 for coupling electromagnetic signals between the resonators 38 and 40, and the sheet 46 is provided with an iris 50 for coupling electromagnetic signals between the resonators 40 and 42. The resonators 38, 40, and 42 are arranged symmetrically about a common axis 52 (FIG. 3) to form a stack of the resonators. A ground plane 54 is located at the bottom of the resonator stack facing the resonator 38, and a ground plane 56 is located at the top of the resonator stack facing the resonator 42.

The resonator 38 is enclosed in a layer 58 of dielectric material which serves as a spacer between the ground plane 54 and the sheet 44. Similarly, the resonator 40 is enclosed within a layer 60 of dielectric material which supports the resonator 40 spaced apart from the sheets 44 and 46. Also, the resonator 42 is enclosed within a layer 62 of dielectric material which supports the resonator 42 in spaced apart relation between the sheet 46 and the ground plane 56. The foregoing components of the filter 32 including the resonators 38, 40, and 42, the sheets 44 and 46 and the ground planes 54 and 56 are enclosed within a housing 64 of electrically conductive material such as copper or aluminum which serves to shield the other components of the circuit 20 from electromagnetic waves within the filter 32, and to prevent leakage of radiated electromagnetic power from the filter 32. Alternatively, the housing 64 may be formed of a high dielectric-constant material, preferably a ceramic, having electrical properties similar to the material which may be employed in construction of the resonators 38, 40, and 42, as will be described hereinafter.

The three resonators 38, 40 and 42 are presented by way of example, it being understood that, if desired, only two resonators may be provided in the resonator stack or, if desired, four, five, or more resonators may be employed in the resonator stack. Similarly, the two sheets 44 and 46 of FIG. 2 are presented by way of example, it being understood that only one sheet would be employed in the case of a stack of two resonators, and that three sheets would be employed in a stack of four resonators, there being one less sheet than the number of resonators.

It is possible to construct an operative embodiment of the filter 32, wherein the housing 64, the resonators 40, 42, and 44, the sheets 44 and 46, and the ground planes 54 and 56 may all be constructed of electrically conductive material such as metal. Copper or aluminum is a suitable metal, by way of example. But such a construction of the filter 32 would not have the benefits of the invention wherein, in a preferred embodiment of the invention, the resonators 40, 42, and 44 comprise a high dielectric-constant material, preferably a thin ceramic film having a thickness of approximately ten mils and a dielectric constant of at least approximately 80, such a dielectric material being provided commercially under the trade name of TRANSTECH (of Adamstown, Md.) and having part number S8600. Each of the dielectric layers 58, 60 and 62 is fabricated, in a preferred embodiment of the invention, of a material having a low dielectric constant of approximately 2, such a low dielectric material being provided commercially under the trade name Rexolite. A further advantage in the use of the foregoing dielectric material in the layers 58, 60 and 62 is that the dielectric constant is higher than that provided by air with the result that there is a reduction in the physical dimensions of a standing wave produced upon interaction of any one of the resonators 38, 40, and 42 with an electromagnetic signal. This permits the physical size of the filter 32 to be made much smaller than a multi-sectioned cavity microwave filter of similar filter transfer function of the prior art. Still higher dielectric constants may be employed in each of the dielectric layers 58, 60 and 62 for further reduction in the physical dimensions of a standing wave produced upon interaction of any one of the resonators 38, 40, and 42 with an electromagnetic signal. However, such higher dielectric constant would reduce the ratio between the high and the low dielectric constants of the materials in the resonators and the dielectric support layers with a consequent reduction in the efficacy of the electric and the magnetic walls produced at the boundaries between the high and the low dielectric constant materials.

The sheets 44 and 46 are to operate at the same electric potential, and, accordingly, an electrically conductive strap 66 (FIG. 2), which may be fabricated of copper or aluminum, or of the aforementioned high dielectric-constant material connects electrically the sheets 44 and 46 to provide for the equipotential surface. The sheets 44 and 46 may be constructed of metal, as noted above, or in accordance with the principle of the invention, may be constructed of a high dielectric-constant material such as that employed in the construction if the resonators 40, 42, and 44. For larger resonator stacks wherein more of the sheets are employed, the strap 66 is extended to connect electrically all of the sheets to provide for a single equipotential surface. If desired, by way of alternative embodiment to be described in FIG. 3, each of the sheets 44 and 46, as well as such other sheets which may be present, connect to a wall of the housing 64 wherein the housing wall serves to electrically connect the sheets to provide the equipotential relationship. Also, by way of further alternative embodiment, the top and bottom walls 96 and 98 (FIG. 3) of the housing 64 may serve the function of the ground planes 56 and 54 of FIG. 2, respectively.

In the operation of a resonator, two basic modes of oscillation, or resonance, are obtainable wherein a cross-sectional dimension, or diameter, lying in a reference plane 68 (omitted in FIG. 3, but shown in FIGS. 2 and 4) is equal to one-half wavelength of the electromagnetic signal, and wherein a cross-sectional dimension, or diameter, perpendicular to the reference plane 68 is equal to one-half wavelength of the electromagnetic signal. While resonances may be selected to be at the same frequency attained by equal resonator dimensions, generally, the filter transfer function is that of a band-pass filter described mathematically as having a plurality of poles, such as an elliptic function filter or a Chebyshev filter. In such a filter transfer function, each pole, and corresponding resonance, is at a slightly different frequency. Accordingly, the aforementioned diameter lying in the reference plane 68 and the aforementioned diameter lying perpendicularly to the reference plane 68 would be of slightly different lengths.

Individual ones of the resonators 38, 40, and 42 are approximately square, or rectangular, in the sense that the cross-sectional dimensions may differ by one percent, or other amount, by way of example. Furthermore, the cross-sectional dimensions of the resonator 40 differ slightly from those of the resonator 38 and, similarly the cross-sectional dimensions of the resonator 42 differ slightly from those of the resonators 38 and 40. This selection of resonator dimensions establishes a set of resonant wavelengths for the electromagnetic signals lying within the pass band of the filter 32. In the preferred embodiment of the invention, each of the resonators is operated only in its fundamental mode wherein a diameter is equal to a half-wavelength, rather than to a wavelength or higher order mode of vibration of the electromagnetic wave.

Vertical spacing between the resonators 38, 40, and 42, as measured along the axis 52 (FIG. 3), is less than approximately one-quarter or one-tenth of a wavelength to avoid generation of spurious modes of vibration of the electromagnetic signal within the filter 32. Signals are coupled into and out of the filter 32 via some form of coupling means employing any. one of several arrangements of coupling elements disclosed in the figures. For example, as shown in FIG. 2, coupling of signals into and out of the filter 32 is accomplished by means of probes 70 and 72 which represent extensions of the center conductors of the cables 34 and 36 (FIG. 1), and connect directly with the resonators 38 and 42, respectively. As a further example, the probe 70 may provide an input signal to the filter 32 while the probe 72 extracts an output signal from the filter 32. It is noted that the probe 70 lies within the reference plane 68 while the probe 72 is perpendicular to the reference plane 68. The probe 70 establishes a mode of electromagnetic vibration within the resonator 38 such that a standing wave develops and vibrates within the reference plane 68. The probe 72 interacts with an electromagnetic wave vibrating in a plane perpendicular to the reference plane 68 for extracting power from a mode of vibration in the resonator 42 which is perpendicular to the reference plane 68.

Alternatively, two probes 74 and 76 (FIG. 3) may extend in directions parallel to the resonators 38 and 42, respectively, and perpendicularly to a sidewall 78 of the housing 64. The probes 74 and 76 are spaced apart from the resonators 38 and 42 by gaps 80 and 82, respectively, for coupling of electromagnetic power to the resonator 38 and from the resonator 42. By way of alternative configuration in the arrangement of the coupling elements, the probes 74 and 76 lie in a common plane with the axis 52, such as the reference plane 68, or a plane perpendicular to the reference plane 68 and including the axis 52. The probes 74 and 76 may be fabricated of metal or of a high dielectric-constant material such as that employed in the construction of the resonators 38, 40 and 42.

As shown in FIG. 3, the probes 74 and 76 extend, respectively, from coaxial connectors 84 and 90 mounted to the housing sidewall 78. In the case of the probe 74, the coaxial connector 84 comprises an outer cylindrical conductor 86 in electrical contact with the sidewall 78, and an electrically insulating sleeve 88 which positions the probe 74 centrally along an axis of the outer conductor 86 and encircled by the sleeve 88 to insulate the probe 74 from the outer conductor 86. Thereby, the probe 74 is also a center conductor of the connector 84. Similarly, the probe 76 is the center conductor of the coaxial connector 90 which has a cylindrical outer conductor 92 spaced apart from probe 76 by an electrically insulating sleeve 94. Also shown in the embodiment of FIG. 3 is the connection of the housing sidewall 78 to both of the sheets 44 and 46 to equalize their potential in the manner of the strap 66 of FIG. 2. In addition, in the embodiment of FIG. 3, the functions of the ground planes 54 and 56 of FIG. 2 are provided by the bottom wall 96 and the top wall 98, respectively, so that the additional physical structures of the ground planes 54 and 56 (FIG. 2) are not employed in the embodiment of FIG. 3.

In the simplified presentation of the filter 32, as presented in FIG. 4, only the resonators 38 and 40 are shown, along with the sheet 44. Also, the corresponding layers 58 and 60 of dielectric material have been omitted to simplify the presentation. By way of alternative embodiment, the coupling elements are presented as pads 100 and 102 which extend partway beneath a peripheral portion of the resonator 38 and are spaced apart therefrom by gaps 104 and 106. Unlike the arrangement of coupling elements of FIGS. 2 and 3, in FIG. 4 both of the coupling elements, namely, the pads 100 and 102, are coupled to the same resonator, namely, the resonator 38. The pad 100 lies within the reference plane 68, and the pad 102 lies in the plane perpendicular to the reference plane 68. By way of further embodiment, a connecting element in the form of a pad 107, shown in phantom, may be located within the reference plane 68 adjacent the resonator 40, in lieu of the pad 102 for coupling signals from the filter 32. The pads 100, 102, and 107 may be fabricated of metal or of a high dielectric-constant material such as that employed in the construction of the resonators 38, 40 and 42.

It is advantageous in the practice of the invention to provide at least one of the resonators of the filter 32, and preferably all of the resonators, such as the resonators 38, 40, and 42 (FIGS. 2 and 3), with a perturbation located in a peripheral region of a resonator at a site distant from the reference plane 68 and from a coupling element. One form of construction of the perturbation is a notch 108 shown in FIG. 4 and shown partially in FIG. 2. An alternative form of the perturbation is a tab 110 shown in FIG. 5. The perturbation causes an interaction between the two orthogonal modes of vibration of electromagnetic waves within any one of the respective resonators 38, 40, and 42, such that the presence of any one of the modes induces the presence of the other mode. Thus, by way of example, upon excitation of a mode of vibration in the reference plane 68 by application of a signal on the pad 100 (FIG. 4), the perturbation, in the form of the notch 108, introduces a coupling between the modes such that the mode of vibration in the reference plane 68 induces vibration also in the plane perpendicular to the reference plane 68. Thereby, upon application of an electromagnetic signal to the tab 110, both orthogonal modes of vibration of electromagnetic standing waves appear at the resonator 38.

The use of the dual modes of vibration of the electromagnetic wave in each of the resonators provides for two poles of the mathematical expression of the filter transfer function for each resonator. Thereby, the number of required resonators is equal to only half of the number of poles of the transfer function. This reduces the overall dimensions of the filter in the direction of the height of the filter, as measured along the direction of the aforementioned common axis. It is advantageous to include top and bottom ground planes, which may be fabricated of metal plates or foil, or a lamina of the high dielectric-constant material, wherein the stack of resonators is disposed between the ground planes. This reduces leakage and improves the quality of the resonances.

In FIG. 4, the iris 48 in the sheet 44 is in the form of a cross having transverse arms 112 and 114 located on radii extending from the axis 52. The arm 114 lies within the reference plane 68 to couple energy of the vibrational mode at the resonator 38 lying within the reference plane 68 to the resonator 40. Similarly, the arm 112 is oriented perpendicularly to the reference plane 68 to couple energy of the vibrational mode at the resonator 38 lying perpendicular to the reference plane 68 to the resonator 40. Thereby, two orthogonal modes of vibration appear also at the resonator 40. In a similar fashion, the iris 50 (shown in FIGS. 2 and 3) couples electromagnetic energy from the two modes of vibration at the resonator 40 to the resonator 42. In view of the fact that each of the resonators carries two modes of vibration of electro-magnetic energy, coupling elements can be applied to any one or any pair of the resonators, and may be disposed in a common vertical plane, as in FIG. 3, or in transverse vertical planes, as in FIG. 2.

In the iris 48, the arms 112 and 114 may be of equal length and width to provide for an equal amount of coupling of the corresponding electromagnetic modes. Alternatively, if desired, one of the arms, such as the arm 114 may be made shorter than the other arm 112. This provides for reduced coupling of the mode which is parallel to the plane 68 relative to the amount of coupling of the mode which is perpendicular to the plane 68. Such variation in the amount of coupling among the various modes is a factor to be selected for attaining a desired filter transfer function. In similar fashion, cross arms of the iris 50 may be adjusted for equal or unequal amounts of coupling of the corresponding electromagnetic modes. Coupling among modes of different ones of the resonators may also be adjusted by varying spacing between neighboring ones of the resonators, as will be described with reference to FIG. 14. It is noted that the foregoing discussion in the generation of the orthogonal modes of vibration applies also to circular resonators, such as the resonators 116 and 118 of FIG. 5. The same form of sheet, such as the sheet 44 and the same form of iris, such as the iris 48 may be employed with the circular resonators 116 and 118. Similarly, the coupling elements, such as the pads 100 and 102, may be employed also with the corresponding circular resonators 116 and 118 of FIG. 5.

FIG. 6 shows a plan view of the iris 48 in the situation where the two arms 112 and 114 are equal. FIG. 7 shows a plan view of an alternative configuration of the iris, namely an iris 48A having an arm 114A which is shorter than the arm 112A. If desired, the shape of the iris can be altered such that, instead of use of an iris having the shape of a cross, an iris in the shape of a circle or an ellipse may be employed. FIG. 8 shows a plan view of a circular iris 120, and FIG. 9 shows a plan view of an elliptical iris 122. The symmetry of the circular iris 120 provides for an equal amount of coupling of two orthogonal electromagnetic modes. In the case of the iris 122 of FIG. 9, the long dimension of the iris-122 may be positioned perpendicularly to the reference plane 68 (FIG. 4) in which case the electromagnetic mode resonating in the plane perpendicular to the reference plane 68 will be coupled more strongly to a neighboring resonator than the orthogonal electromagnetic mode which is parallel to the reference plane 68. Accordingly, an iris with circular symmetry serves to couple power from both of the modes of a resonator equally to both of the modes of the next resonator of the series. In the case of the elongated iris, there is preferential coupling of power of one the modes, a tighter coupling, with a greater power transfer for the vibrational mode extending along the elongated direction of the iris, and with reduced coupling for the mode extending along the transverse direction of the iris.

The resonator need not be substantially square as shown in FIG. 4, or substantially circular as shown in FIG. 5, but may, if desired, be provided with an annular form as shown in FIGS. 10 and 11. FIG. 10 shows a plan view of an annular resonator 124 shown positioned, schematically upon a layer of dielectric material, such as the layer 62. In FIG. 11, there is shown schematically a resonator 126 disposed upon the layer 62 of dielectric material and having an elliptical annular form, as compared to the circular annular form of FIG. 10.

FIG. 12 shows a simplified exploded view of a portion of a filter disclosing the bottom ground plane 54, the resonator 116, and the electrically-conductive sheet 44 with the iris 48 therein. Instead of the probes 70 and 72 of FIG. 2, or the probes 74 and 76 of FIG. 3, or the pads 100 or 102 of FIGS. 4 and 5, FIG. 12 shows a further form of coupling element wherein a pair of orthogonal coupling elements are formed as slots 128 and 130 disposed in the ground plane 54. The slot 128 lies in the reference plane 68 (FIG. 4), and the slot 130 is perpendicular to the reference plane 68, and lies on a radius extending from the axis 52.

Probes 132 and 134 are disposed on the back side of the ground plane 54, opposite the resonator 116, and are oriented perpendicularly to the slots 128 and 130, respectively, and are positioned parallel to and in spaced-apart relation to the ground plane 54. The probes 132 and 134 excite an electromagnetic signal in the slots 128 and 130, respectively, with the slots 128 and 130 serving to excite orthogonal modes of electromagnetic waves within the resonator 116.

In the fragmentary view of FIG. 13, there is shown yet another embodiment of coupling element wherein a probe 136 is oriented perpendicularly to the resonator 116 and spaced apart therefrom by a gap 138. The probe 136 is mounted to the ground plane 54 and passes through the ground plane 54 via an aperture 139 therein by means of an electrically-insulating sleeve 140 disposed within the aperture. The sleeve 140 serves to support the probe 136 within the ground plane 54.

FIG. 14 shows a stack 142 of resonators 144, 146, 148, 150 and 152 with a set of electrically conducting sheets 154, 156, 158 and 160 disposed therebetween. The sheets are understood to include coupling irises (not shown in FIG. 14). The resonator stack 142 demonstrates an embodiment of the invention having additional resonators and sheets with coupling irises therein. FIG. 14 also demonstrates a variation of coupling strength between various ones of the resonators attained by a variation in spacing between the various resonators. For example, the central resonator 148 may be spaced at relatively large distance between the resonators 146 and 150, as compared to a relatively small spacing between the resonators 144 and 146 and a relatively small spacing between the resonators 150 and 152. In the embodiment of FIG. 14, the resonators may have the same form as shown in FIG. 4 wherein the perturbations, shown as notches 108, are oriented at 45 degrees relative to the reference plane 68. Alternatively, the resonators (FIG. 14) may have the same form as the resonators of FIG. 5 wherein the perturbations, shown as tabs 110 are oriented at 45 degrees relative to the reference plane 68 (FIG. 4). Or by way of still further embodiment, one or more of the resonators of FIG. 14 may have the configuration of the resonator 162 shown in FIG. 15 wherein the perturbation is in the form of a notch 164 extending toward the center of the resonator. In all of the embodiments, the resonators and the electrically-conducting sheets have a planar form, and are positioned symmetrically about the central axis 52.

If desired, a single-mode filter may be implemented in a similar stacked configuration by deleting the foregoing perturbations, and by providing that the input and the output coupling elements are coplanar. The principles of the invention can be obtained with a stack of resonators, such as the stack 142 without use of the ground planes 54 and 56 (FIG. 2), however, there would be significant leakage of electromagnetic energy which might interfere with operation of other components of the circuit 20 (FIG. 1). Such leakage might decrease the Q of the filter transfer function. Use of the ground planes 54 and 56 on the bottom and the top ends of the stack of resonators is preferred because it tends to confine the electromagnetic energy within the region of the filter. Still further beneficial results are obtained by mounting the resonator stack within an electrically conductive enclosure, such as the housing 64 (FIG. 2) which retains the electromagnetic energy within the filter, and prevents leakage of the energy to other components of the circuit 20.

FIG. 15 shows a resonator 162 which is a further embodiment of the resonator 116 previously shown in FIGS. 5 and 12. In FIG. 15, the resonator 162 is provided with a perturbation in the form of a notch 164, the notch 164 acting in a fashion substantially the same as that of the perturbation of the tab 110 of FIGS. 5 and 12 to couple between two modes of electrical vibration.

Figure 16:
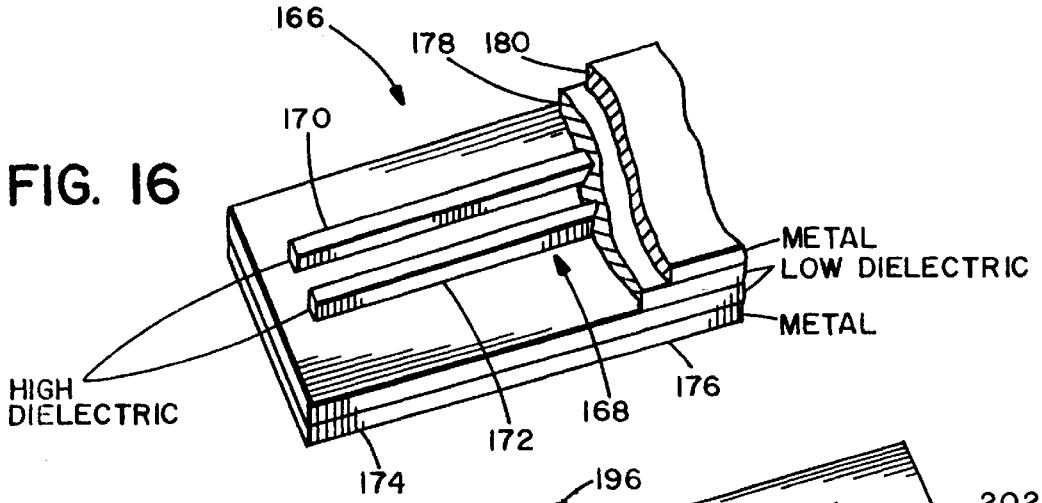
FIG. 16 is a stylized view of a coplanar waveguide formed within a stripline structure with a portion of a dielectric layer and a ground plane being cutaway to show construction of the coplanar waveguide in microstrip form.

FIG. 16 shows a portion of an electric circuit 166 having a coplanar waveguide 168 comprising two elongated electrical conductors 170 and 172 which are configured as bars, and spaced apart and which are parallel to each other. The conductors 170 and 172 are characterized by a medium/structure of high dielectric constant, and are supported by a dielectric layer 174. A ground plane 176 is disposed on a surface of the dielectric layer 174 opposite the conductors 170 and 172. The composite structure of the conductors 170 and 172, and the dielectric layer 174 with the ground plane 176 constitutes a microstrip structure. Alternatively, if desired, the coplanar waveguide 168 may be fabricated as a stripline structure by placing a further dielectric layer 178 on top of the conductors 170 and 172 and a further ground plane 180 on top of the dielectric layer 178. In accordance with the invention, the electrical conductors 170 and 172 are constructed of the high dielectric-constant material, such as that employed in the construction of the resonators 38, 40, and 42 of FIGS. 2 and 3, and the dielectric layers 174 and 178 are constructed of the low dielectric-constant material such as that employed in the layer 58 of FIGS. 2 and 3. In the coplanar waveguide 168 of FIG. 16, the conductors 170 and 172 function in the same fashion as do electrically conductive metal conductors of the prior art, and the dielectric layers 174 and 178 serve to insulate the conductors 170 and 172 from each other as well as to cooperate with the conductors 170 and 172 in forming a characteristic impedance of the transmission line of the coplanar waveguide 168. The ground planes 176 and 180 are fabricated typically of an electrically conductive metal, however, if desired, in accordance with the invention, the ground planes 176 and 180 can be constructed also of the high dielectric-constant material.

In accordance with the invention, the embodiments of FIGS. 2 and 16 demonstrate how two elements of the high dielectric-constant material separated by the low dielectric-constant material can be employed to construct useful electromagnetic structures. Thus, in FIG. 2, the elements of the high dielectric-constant material serve as resonators, such as the resonators 40 and 42 in the filter 32. In FIG. 16, the two conductors 170 and 172, formed of high dielectric constant material separated by low dielectric-constant material serve the function of a coplanar waveguide. Two spaced-apart elements of the high dielectric constant material separated by the low-dielectric material and/or supported by the low dielectric-constant material can serve the function of a microwave coupler as is depicted in FIG. 17.

Figure 17:
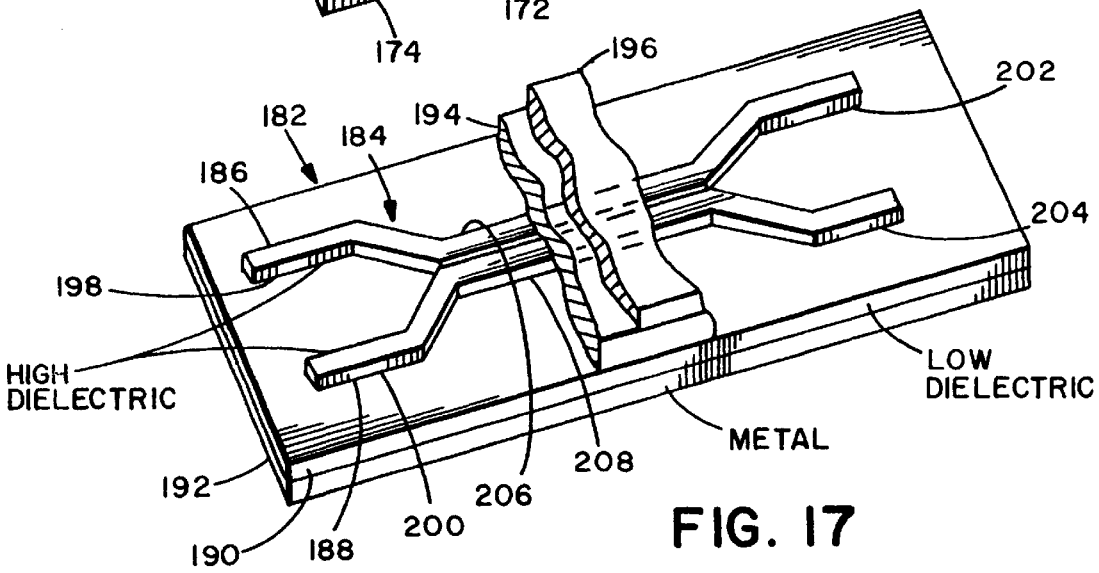
FIG. 17 is a stylized view of a microwave coupler formed within a stripline structure with a portion of a dielectric layer and a ground plane being cut away to show construction of the microwave coupler in microstrip form.

FIG. 17 shows a portion of an electric circuit 182 including a microwave coupler 184 comprising two elongated electrical conductors 186 and 188. The two conductors 186 and 188 are characterized by a medium/structure of high dielectric constant, and are disposed upon a layer 190 of dielectric material, with a ground plane 192 disposed on a surface of the layer 190 opposite the conductors 186 and 188. The construction of the conductors 186 and 188 upon the layer 190 in conjunction with the ground plane 192 constitutes a microstrip structure. If desired, the circuit 182 can be constructed in the form of stripline by placing an additional layer 194 of dielectric material upon the top of the conductors 186 and 188 and extending between the conductors 186 and 188, the layer 194 being contiguous the layer 190 at locations away from the conductors 185 and 188. A further ground plane 196 is disposed above the layer 194 to complete the stripline structure. The dielectric layer 194 and the ground plane 196 are shown only in fragmentary view to facilitate description of the coupler 184. Typically, in accordance with the invention, the ground planes 196 and 192 may be constructed of an electrically conductive metal, while the conductors 186 and 188 are constructed of a high dielectric-constant material such as that employed in the conductors 170 and 172 of FIG. 16. In FIG. 17 the dielectric layers 190 and 194 are formed of low dielectric-constant material, such as the materials employed in the layers 174 and 178 of FIG. 16.

In the operation of the coupler 184, the conductor 186 has an input terminal portion 198, and the conductor 188 has an input terminal portion 200. The terminal portions 198 and 200 are parallel to each other. Two output terminals are provided by terminal portions 202 and 204 respectively of the conductors 186 and 188. The terminal portion 202 is parallel to the terminal portion 204. In the conductor 186, between the terminal portion 198 and 202, the conductor 186 is bent toward the conductor 188 to provide a linear central portion 206. In similar fashion, the conductor 188, between the terminal portions 200 and 204, is bent towards the conductor 186 to provide a linear central portion 208 which is parallel to the central portion 206 and spaced apart from the central portion 206. The spacing between the central portions 206 and 208 is sufficiently close together to allow for coupling of an electromagnetic signal between the two conductors 186 and 188. The coupler 184 functions as a four-port coupler, in a manner analogous to that of microstrip or stripline couplers fabricated of metal conductors of the prior art. By way of alternative embodiment of the circuit 182, it is noted that the ground planes 192 and 196 may be fabricated of the high dielectric-constant material in lieu of metal, if desired.

Figure 18:
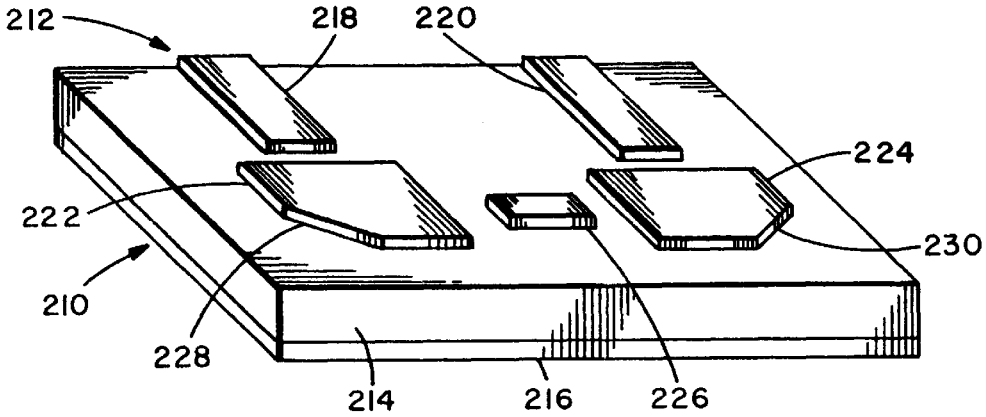
FIG. 18 shows a microstrip form of construction of a four-pole filter wherein components of the filter are disposed of thin film of high dielectric-constant material disposed upon a substrate of low dielectric-constant material.

FIG. 18 shows a portion of a microwave circuit 210 which has the same overall configuration as the circuit shown in FIG. 4 of Fiedziuszko et al, U.S. Pat. No. 5,136,268, and functions in the same manner as the Fiedziuszko et al circuit. The circuit 210 is depicted in microstrip configuration, it being understood that the circuit 210 may be constructed in stripline format in the manner taught with respect to FIGS. 16 and 17. In FIG. 18, the circuit 210 is a fourth order filter 212 constructed with a dielectric substrate 214 with an electrically conductive ground plane 216 on a bottom surface of the substrate 214, and with a set of electrically conductive filter components which are characterized by a medium/structure of high dielectric constant, and are deposited on the top surface of the substrate 214. The filter components include an input leg 218 and an output leg 220, an input patch-222 and an output patch 224 interconnected by a rectangular coupling element 226.

Each of the patches 222 and 224 has a substantially square shape with a diagonal notch 228 and 230, respectively, disposed in one corner of the square patch. The filter components are constructed upon the substrate 214 in the fashion of thin films produced by photolithography and well-known etching or deposition processes. Facing edges between the legs 218 and 220 and their respective patches 222 and 224 are parallel, with a spacing providing for capacitive coupling between the legs 218 and 220 and their respective patches 222 and 224. Similarly, the opposed edges of the coupling element 226 and the corresponding edges of the patches 222 and 224 are parallel and are spaced apart with a spacing to provide for capacitive coupling between the coupling element 226 and the patches 222 and 224. The amount of capacitive coupling is determined in accordance with well-known filter design to establish the desired filter characteristic. The notches 228 and 230 provide for a coupling between one mode of electromagnetic vibration in a patch and an orthogonal mode of electromagnetic vibration within a patch in the same manner as has been described hereinabove with reference to the resonators 38 and 40 of FIG. 4. In FIG. 18, the substrate 214 is fabricated of a low dielectric-constant material such as dielectric material of the layer 38 in FIG. 2. The filter components 218, 220, 222, 224, and 226 are fabricated of the high dielectric-constant material employed in the construction of the resonators 38, 40, and 42 of FIGS. 2 and 3. The ground plane 216 may be fabricated of metal or, if desired, may be fabricated of a high dielectric-constant material such as that employed in the construction of the components of the filter 212.

It is noted that in each of the circuits 166, 182, and 210 of the FIGS. 16, 17 and 18, respectively, that the theory of operation of the circuits, in accordance with the invention, provides for electrical conduction of electromagnetic signals within the conductors 170 and 172 of FIG. 16, within the conductors 186 and 188 of FIG. 17, and within the filter components of the filter 212 of FIG. 18. Such electrical conduction takes place by virtue of the electrical conductivity provided by the high dielectric-constant material and the electrical insulating properties of the lower dielectric-constant material. The electrically insulating property of the low-dielectric material of the layers 174 and 190 of FIGS. 16 and 17, as well as in the substrate 214 of FIG. 18 constrain the electrical currents to flow within the conductors 170 and 172 of FIG. 16, the conductors 186 and 188 of FIG. 17 and the filter components of the circuit 210 of FIG. 18. Thereby, in accordance with the invention, one may substitute the high dielectric-constant material in place of metal for the construction of well-known types of electromagnetic circuits. A fourth order filter 212 is provided by way of example and, if desired, may be readily converted to a first order filter by retaining the patch 222 which is capacitively coupled to the input leg 218, and by deleting the output patch 224 and the coupling element 226 which serve to couple the input patch 222 to the output leg 220. Coupling between the patch 222 and the output leg 220 is then accomplished by simply extending the output leg 220 to the former location of the coupling element 226 whereby there is capacitive coupling between the output leg 220 and the patch 222.

Figure 19:
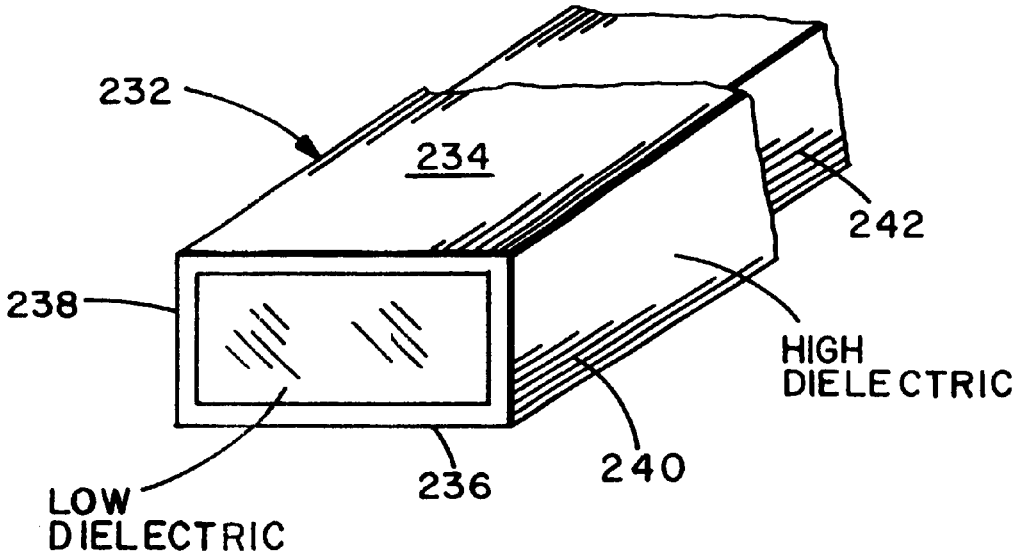
FIG. 19 shows construction of a rectangular waveguide wherein a core of low dielectric-constant material is enclosed with walls of high dielectric-constant material.
Figure 20:
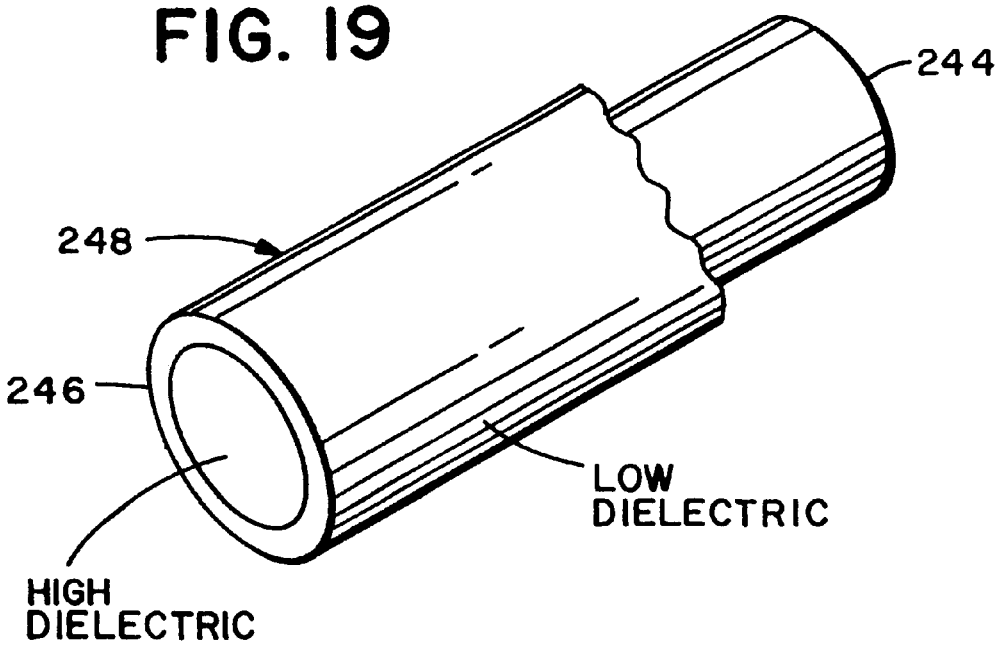
FIG. 20 shows a circular waveguide composed of a rod of high dielectric-constant material enclosed with a cladding of low dielectric-constant material.

FIGS. 19 and 20 provide still further examples of the use of the high dielectric-constant material as a substitution for metal in the construction of microwave transmission lines. In FIG. 19, a waveguide 232 of rectangular cross section is provided with top and bottom walls 234 and 236, respectively, and sidewalls 238 and 240 which are constructed of the high dielectric-constant material, and wherein an inner core 242 of the waveguide 232 is filled with the low dielectric-constant material. An electromagnetic wave propagates within the core 242 by reflection from the boundary between the low dielectric-constant material of the core 242 and the high dielectric-constant material of the waveguide walls 234, 236, 238 and 240.

In FIG. 20, a solid rod-244 of high dielectric-constant material and of circular cross-section is clad with a cladding 246 of the low dielectric-constant material to form a circular waveguide 248. In the waveguide 248, an electromagnetic wave propagates through the high dielectric-constant material of the rod 244 by reflection from the interface between the high dielectric-constant material of the rod 244 and the low dielectric-constant material of the cladding 246.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An electromagnetic wave propagating structure comprising:

a set of elements of dielectric material and a substrate of dielectric material, the dielectric material of said set of elements having a high dielectric constant in excess of 80, the dielectric material of said substrate having a dielectric constant less than 2;

wherein a first element of said set of elements extends in a longitudinal direction along a first side of said substrate; and a second element of said set of elements extends in said longitudinal direction along said first side of said substrate and is spaced apart from said first element to define a coplanar waveguide.

2. An electromagnetic wave propagating structure comprising:

a set of elements of dielectric material and a substrate of dielectric material, the dielectric material of said set of elements having a high dielectric constant in excess of 80, the dielectric material of said substrate having a dielectric constant less than 2;

wherein a first element of said set of elements extends in a longitudinal direction along said substrate;

a second element of said set of elements extends in said longitudinal direction along said substrate and is spaced apart from said first element to define a coplanar waveguide; and a third element of said set of elements is supported by said substrate, and is spaced apart from said first and said second elements, and said third element of said set of elements extends in said longitudinal direction and transversely of said first and said second elements to serve as a ground plane.

* * * * *